US005163778A

United States Patent [19]

Botero

[11] Patent Number: 5,163,778

[45] Date of Patent: Nov. 17, 1992

[54] COMBINATION PADDLE, HOOK AND PUMP AND METHOD THEREFOR

[76] Inventor: Joseph L. Botero, 4241 N. 55th Pl., Phoenix, Ariz. 85018

[21] Appl. No.: 776,206

[22] Filed: Oct. 15, 1991

[51] Int. Cl.[5] ..... B63H 16/64

[52] U.S. Cl. ..... 440/101; 114/221 R

[58] Field of Search ..... 440/101; 114/221 R; 416/69, 74

[56] References Cited

U.S. PATENT DOCUMENTS

| | | | |
|---|---|---|---|
| 1,512,391 | 10/1924 | Abraham | 440/101 |
| 2,702,910 | 3/1955 | Ake | 114/221 R |
| 3,030,641 | 4/1962 | Ake | 440/101 |
| 3,040,693 | 6/1962 | Bunker | 114/221 R |
| 3,165,067 | 1/1965 | Greenwald | 114/221 R |
| 5,042,805 | 8/1991 | Nakai | 440/101 |

*Primary Examiner*—Edwin L. Swinehart
*Attorney, Agent, or Firm*—Harry M. Weiss

[57] ABSTRACT

A combination paddle, hook and pump is disclosed wherein the hook is located at one end of the paddle and is contoured to permit smooth paddling action by the paddle. The hook can be rotated from a closed, non-hooking position to an open, hooking position and has a pair of openings therein to permit the pump to either pump air or water into an object or to pump a fluid such as water from a source of the fluid. The paddle comprises a dielectric material that contains metal particles to reflect a radar beam thereby permitting a boater using the paddle in a raised position to be spotted by radar.

8 Claims, 2 Drawing Sheets

COMBINATION PADDLE, HOOK AND PUMP AND METHOD THEREFOR

BACKGROUND OF THE INVENTION

1. Field of the Invention

This invention generally relates to a paddle and method therefor and, more particularly, this invention relates to an improved paddle which includes a hook and a water or air pump, and a method therefor.

2. Description of the Prior Art

Paddles (or oars) are often used on many types of small boats as the primary means of propulsion such as, for example, on rowboats and canoes. Paddles are also usually used as a safety feature on other larger boats to provide a secondary or back-up means of propulsion such as, for example, on motorboats or sailboats.

To improve the usefulness of a paddle, the prior art has disclosed incorporating a water or air pump as part of the construction of the paddle. In this connection, U.S. Pat. Nos. 3,044,410 and 3,095,825 to Warren F. Edmundson and John W. Sandberg, respectively, disclose a combination oar and water or air pump. This combination oar or paddle and air or water pump feature has enabled boaters to use a single device, namely, a paddle or oar that is used as a primary or secondary means of propulsion to also serve as a pump to either pump water out of the vessel in the event of a leak or to pump air into inflatable safety equipment, such as a life preserver or raft. By having the combination pump and paddle, valuable space is saved in a boat which otherwise requires separate devices for the two functions (paddling and pumping).

However, boaters often find themselves in the position of paddling to a dock or to another boat, perhaps for safety reasons such as when they are in rough water or facing strong currents, and they may encounter great difficulty in mooring their boats or coupling their boat to another boat.

In addition, boaters may also find themselves in hazardous or life threatening situations out of eye view from land or any other boats. Included in these potential dangers are water entering the vessel from stormy seas, boat leaks, etc.

Accordingly, a need existed to provide a significantly improved paddle and method which was also able to function (besides serving as a paddle and pump) to provide boaters with assistance in mooring their boats or coupling their boats to other boats thereby limiting the consequences of potential boating dangers or threats and, if needed, also provide a radar reflection device using the same improved paddle thereby providing an added safety feature to enable others with a radar scanning system to detect and locate the presence of a lost or floundering boat.

SUMMARY OF THE INVENTION

Therefore, it is an object of this invention to provide an improved paddle and method therefor.

It is another object of this invention to provide an improved paddle and method therefor which may also be used as both a pump and a hook.

It is a further object of this invention to provide an improved paddle and method therefor which incorporates a hook at one end thereof to grasp the edge of a dock, boat or other desired object for mooring purposes.

It is a still further object of this invention to provide an improved paddle and method therefor wherein the paddle provides a means of reflecting (being spotted by) radar particularly when a boat is in danger and not within eyesight of land or another boat.

It is still another object of this invention to provide an improved paddle and method therefor wherein the paddle incorporates the combination of four features, namely, a paddle feature for propulsion, a pump feature for pumping air or water, a hook feature for mooring purposes, and a radar reflection feature to permit the detection of the paddle (and of course, the accompanying boat) by a radar scanning system that is located out of eyesight of the boat.

The foregoing and other objects, features and advantages will be apparent from the following description of the preferred embodiments of the invention as illustrated in the accompanying drawings.

DESCRIPTION OF THE PREFERRED EMBODIMENT

Figure 1:
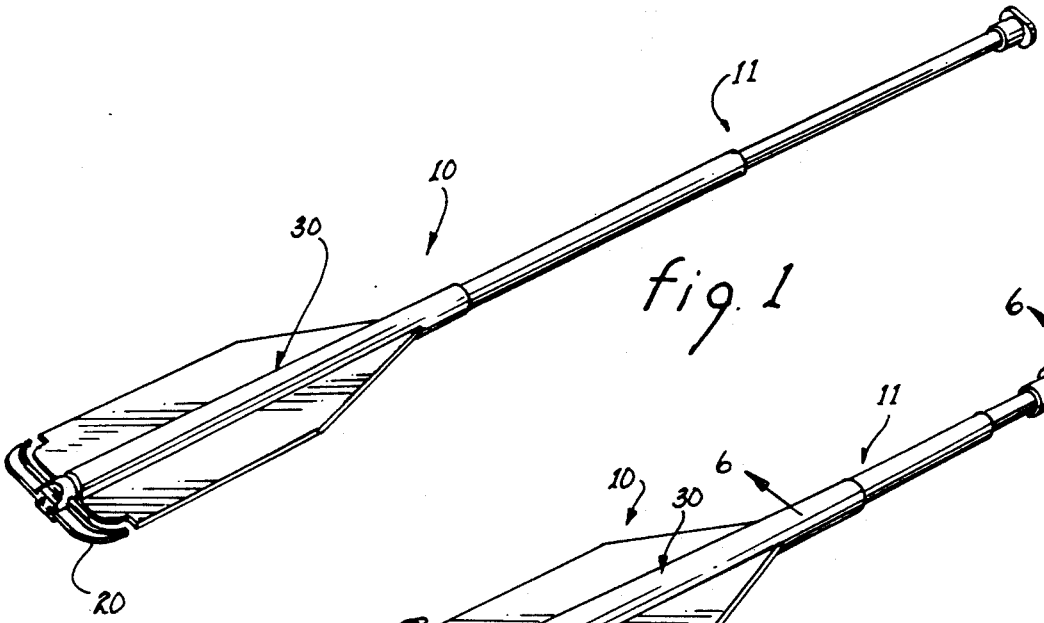
FIG. 1 is a top perspective view of the embodiment of a paddle according to the invention disclosing a hook in a closed position at one end thereof and a pump handle in an extended position at the other end thereof.
Figure 1A:
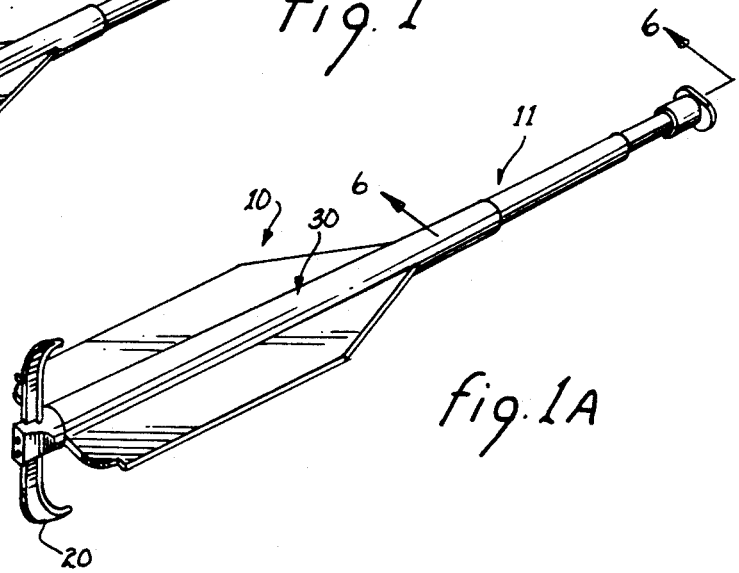
FIG. 1A is a top perspective view of the paddle of FIG. 1 with the hook shown in an open position ready to be used to grab onto some object and the pump handle in a substantially fully depressed position.

As shown in FIGS. 1 and 1A, a paddle 10 in accordance with this invention is provided. Paddle 10 includes a handle assembly 11 located on one end and a pivotal hook 20 located on the other (front) end. The paddle 10 comprises a pump assembly 30 which includes a portion of the handle assembly 11, a portion of the hook 20 and an internal enlarged conduit portion connected up to conduits located in the hook 20. FIG. 1 shows the handle assembly 11 in an extended position prior to a pumping action whereas FIG. 1A shows the handle assembly 11 after the handle assembly 11 is propelled or moved inwardly to its (telescopic) retracted position during pumping action.

Figure 4:
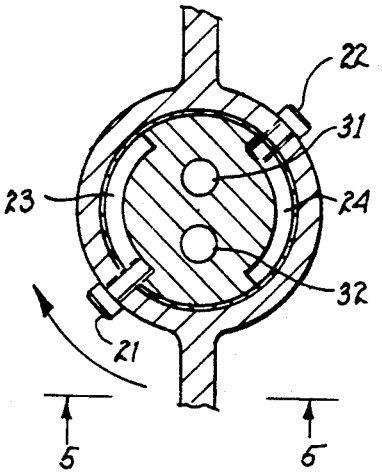
FIG. 4 is a view taken along line 4—4 of FIG. 3 showing the details of a pair of mechanical stops cooperating with a respective pair of slots to permit hand rotation of the hook to no more than 90° to its open (hook or grab) position (as shown in FIG. 1A) or to permit rotation of the hook to return to its closed (non-hooking) position (as shown in FIG. 1).
Figure 5:
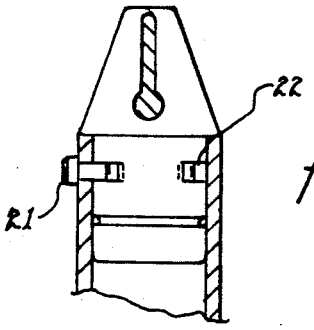
FIG. 5 is a view taken along line 5—5 of FIG. 4.

The hook 20 is rotated 90° as shown in FIG. 1A from the position shown in FIG. 1 to position the hook 20 in place to gab an object during a mooring operation. Two rivets 21 and 22 (or pins secured in a manner other than by rivetting) as shown in FIG. 4, are respectively inserted into slots or cavities 23 and 24 to permit the hook 20 only a 90° rotation to the open position as shown in FIG. IA. This combination of rivets 21, 22 and cavities or slots 23, 24 also permits the hook 20 to be hand pivoted back to the closed position as shown in FIG. 1. As can be seen with reference to FIGS. 1, 1A, and 2, the hook 20 is uniquely configured to follow the contour or configuration of the paddle 10 thereby permitting smoother paddling action when used in the closed position as shown in FIG. 1.

Figure 2:
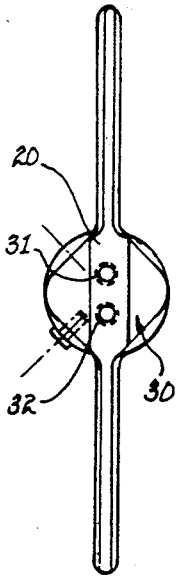
FIG. 2 is a front end view of the paddle and hook of FIG. 1 showing the hook in the front, (in its closed position) contoured to provide a substantially continuous shape with the paddle and having a pair of openings in the hook to facilitate the pumping action.
Figure 3:
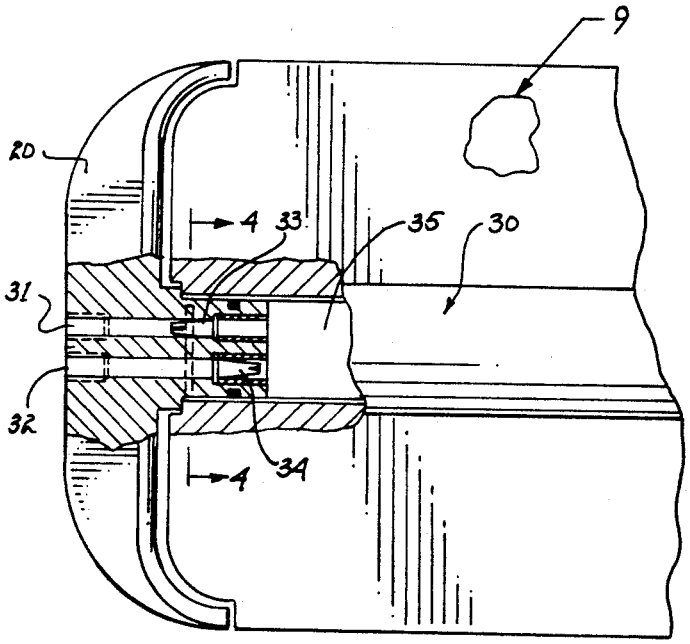
FIG. 3 is an enlarged side view of the front end portion of the paddle of FIG. 1 with parts thereof shown in section to disclose the details of a portion of a pump within both the hook and paddle of FIG. 1.

Pump 30, is comprised of two conduits 31 and 32 located in the hook 20 (see FIGS. 2 and 3). As shown in FIG. 3, conduit 31 has a flexible nipple 33, (preferably of rubber or the like) which tapers towards the front end of the paddle 10 and conduit 32 has a nipple 34 (preferably of rubber or the like) which tapers towards the opposite (rear) end of the paddle 10. Conduits 31 and 32 both communicate with a center conduit 35 (see FIG. 3) which extends up to a plunger 35P (see FIG. 6) that serves as a means of forcing air through center conduit 35 and out conduit 31 when the plunger 35P is moved forwardly by pushing the handle assembly 11 inwardly as shown in FIG. 1A.

As shown in FIG. 1, when the handle assembly 11 is fully extended, nipple 33 closes and nipple 34 opens, as a fluid such as water enters conduit 32. When handle assembly 11 is fully depressed, as shown in FIG. 1A, nipple 33 opens and nipple 34 closes, allowing air to pass through conduit 31. In operation, the depression (FIG. 1A) and extension (FIG. 1) of the handle assembly 11, respectively, pushes air out conduit 31 from center conduit 35 and sucks or pulls water in through conduit 32 into center conduit 35 and out an opening (not shown) at an end portion of the handle assembly 11.

Figure 6:
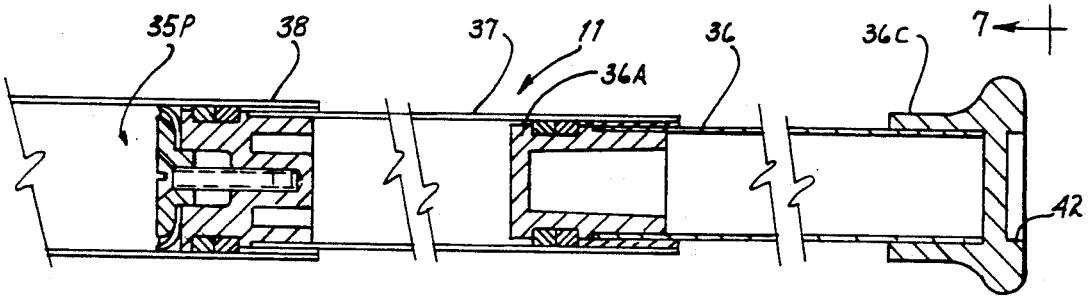
FIG. 6 is a detailed sectional view taken along line 6—6 of FIG. 1A showing the telescoping and twist lock features of the handle of the paddle.

FIG. 6 discloses the structural details of the telescopic handle assembly 11. The telescopic handle assembly 11 comprises an end hollow conduit (preferably shaped like a cylinder) 36 that preferably serves as a storage container for carrying small objects after removal of cap 36C. Conduit 36 carries a twist lock member 36A at an end thereof that telescopes within cylinder 37. The twist lock member 36A and the plunger 35P both operate in the same manner and serve to lock the respective cylinders 36 and 37 within cylinders 37 and 38 in any desired position by a twisting action. The twist lock or cam lock structure is disclosed in the above referenced prior U.S. Patents. The plunger 35P serves to push air into conduit 31 located within the hook 20 or to draw water into conduit 32 located within the hook 20.

Figure 7:
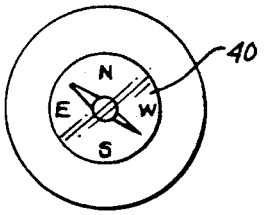
FIG. 7 is an end view of the paddle of FIG. 1 taken along line 7—7 of FIG. 6 showing the compass located in the recess portion at the end of the handle of the paddle.
Figure 8:
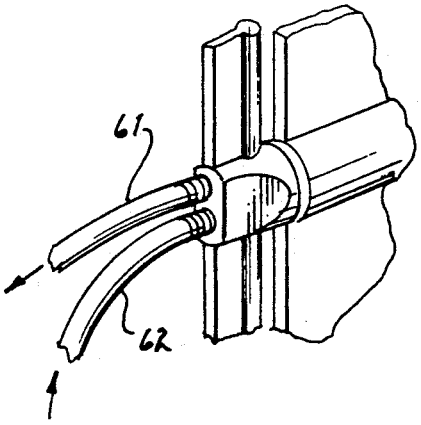
FIG. 8 is a side elevational perspective view showing how the pump features of the paddle of FIG. 1 can be used to permit a pair of hoses to be connected to the pair of openings in the hook portion of the paddle to permit remote use of the pumping operation at the end of the hoses.

FIG. 7 shows a compass 40 which is located on the end cap 36C of handle assembly 11 within a recess 42 located therein.

Figure 9:
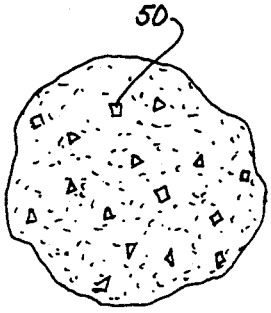
FIG. 9 is a detailed view of the make up of the wider portion of the paddle of FIG. 1 (shown by reference number 9 in FIG. 3) showing the use of metal particles or chips therein to provide radar reflection.

FIG. 9 shows metallic chips 50, located throughout the wide portion of the paddle 10, in a dielectric material such as a very strong plastic whereby these metallic chips serve to reflect radar thereby making it possible to identify and spot the boater using the paddle 10 in a raised position to reflect a radar beam from a distant radar source thereby identifying or spotting the location of the lost boater.

The advantages of paddle 10 are as follows:

1. A boater can use pump 30 to remove water from their vessel or to pump air into an inflatable device, such as a life preserver. Hose extensions 61, 62 can be attached to respective conduits 31 and 32 to allow remote pumping or siphoning up of a fluid.

2. The hook 20 can be used to grasp onto the edge of a dock, another boat or any other type of mooring to facilitate docking and securing the boat.

3. The compass 40 gives a boater directional capabilities, particularly in the event that land is not in sight.

4. The metallic chips located in the paddle 10, which can reflect radar, allow a wayward vessel to be spotted from a distant radar system.

While the invention has been described in its preferred embodiments, it is to be understood that the words which have been used are words of description rather than limitation and that changes may be made within the purview of the appended claims without departing from the true scope and spirit of the invention in its broader aspects.

An indication of the particular need of the device of this invention is exemplified by the published Requirements For Recreational Craft that is distributed by the United States Coast Guard Auxiliary (ANSC #3027 (5-86)) wherein, under the listing of items for safe boating, there is included an Alternate Propulsion heading which lists a paddle or oar and a Dewatering Device heading which proposes a dewatering type device for safe boating. The subject invention combines both of these safe boating items in one device which also functions to provide a hook means for grabbing a line or object which, in effect, provides another safety type feature for a boater.

I claim:

1. A combination paddle comprising, in combination:

a handle assembly;

a paddle portion coupled to said handle assembly;

hook means located outside of and connected to at an end of said paddle portion for permitting coupling of said paddle to an object; and pump means extending from said hook means through said paddle portion and into said handle assembly for permitting pumping of at least one of air into an object and a fluid such as water from a source of the fluid; said pump means including a pair of openings located in said hook means and a pair of hoses, each hose of said pair of hoses coupled to one of said pair of openings in said hook means.

2. The paddle of claim wherein said hook means being rotatable from a closed, non-hooking position to an open, hooking position.

3. The paddle of claim 2 wherein said hook means being rotatable 90° from said closed to said open position and from said open to said closed position.

4. The paddle of claim 3 wherein said hook means in said closed position having a configuration to conform to an end of said paddle portion.

5. The paddle of claim 3 wherein said handle assembly comprising a plurality of telescopic members.

6. The paddle of claim 1 wherein said paddle portion comprising a dielectric material having a plurality of metal particles therein.

7. The paddle of claim 2 wherein said paddle portion comprising a dielectric material having a plurality of metal particles therein.

8. The paddle of claim 4 wherein said paddle portion comprising a dielectric material having a plurality of metal particles therein.

* * * * *

UNITED STATES PATENT AND TRADEMARK OFFICE

CERTIFICATE OF CORRECTION

PATENT NO. : 5,163,778

DATED : November 17, 1992

INVENTOR(S) : Botero

It is certified that error appears in the above-indentified patent and that said Letters Patent is hereby corrected as shown below:

Column 4, line 63, claim 2, change "claim wherein" to -- claim 1 wherein --.

Signed and Sealed this

Twelfth Day of October, 1993

*Attest:*

Bruce Lehman

BRUCE LEHMAN

*Attesting Officer*

*Commissioner of Patents and Trademarks*